US006783025B2

(12) United States Patent
Löhn

(10) Patent No.: US 6,783,025 B2
(45) Date of Patent: Aug. 31, 2004

(54) LID TYPE VESSEL

(75) Inventor: Jürgen Löhn, Klein Meckelsen (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 10/309,853

(22) Filed: Dec. 4, 2002

(65) Prior Publication Data

US 2003/0102323 A1 Jun. 5, 2003

(30) Foreign Application Priority Data

Dec. 5, 2001 (DE) ..... 101 59 804

(51) Int. Cl.[7] ..... B65D 41/10
(52) U.S. Cl. ..... 220/806; 220/375; 215/341
(58) Field of Search ..... 220/240, 315, 220/796, 806, 836, 839, 849, 375; 422/102, 57, 58; 215/306, 341, 354

(56) References Cited

U.S. PATENT DOCUMENTS 4,713,219 A * 12/1987 Gerken et al. ..... 422/102
5,103,990 A 4/1992 Irwin
5,254,314 A * 10/1993 Yu et al. ..... 422/102
5,295,599 A * 3/1994 Smith ..... 215/204
5,513,768 A 5/1996 Smith
5,779,074 A 7/1998 Burns
5,863,791 A 1/1999 Baldzun et al.
6,622,882 B2 * 9/2003 Smith ..... 220/259.1

FOREIGN PATENT DOCUMENTS

DE 9706611 8/1997

OTHER PUBLICATIONS

Patent Abstract of Japan, JP–2001 21 9950A, Aug. 14, 2001.
Patent Abstract of Japan, JP 2001 21 9949A, Aug. 14, 2001.

* cited by examiner

*Primary Examiner*—Jacob K. Ackun, Jr.
(74) *Attorney, Agent, or Firm*—Sidley Austin Brown & Wood, LLP

(57) ABSTRACT

A lid type vessel of an elastic plastic material for laboratory use, specifically in the PCR procedure, comprising a tubular vessel which has a vessel bottom at one end and a vessel opening at the other end, a lid which has a lid bottom and has at least one hollow cylinder on one side of the lid bottom, which is adapted to be inserted into a sealing seat at the vessel inner wall through the vessel opening, and/or which is adapted to be placed onto the end of the vessel having the vessel opening and in a sealing seat on the vessel outer wall in the area of the axial portion, and at least one axial portion of the hollow cylinder or vessel in the area of the sealing seat by means of which the hollow cylinder or vessel is alternately subdivided into harder and softer segments in a circumferential direction.

16 Claims, 5 Drawing Sheets

FIG.4a
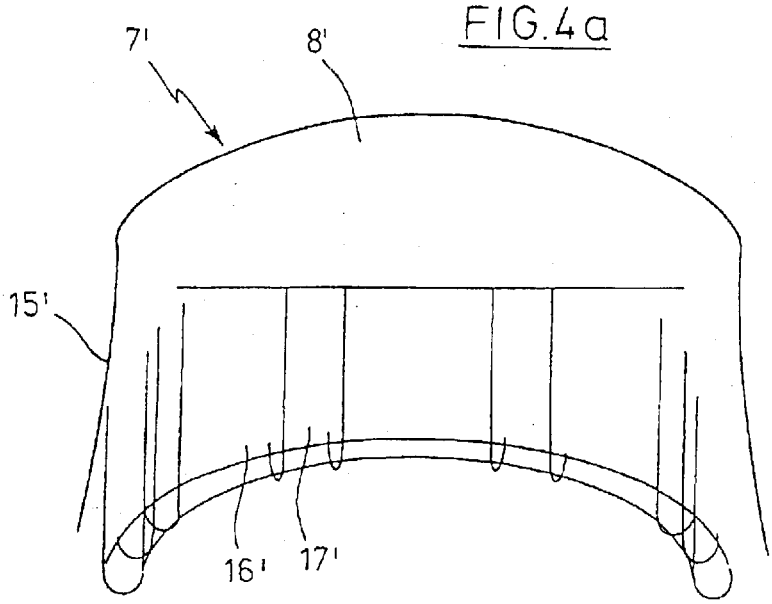
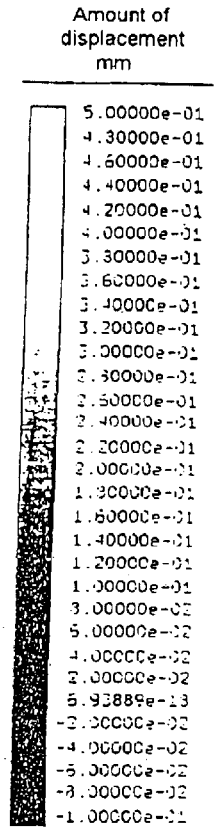
FIG.4b
FIG.5a
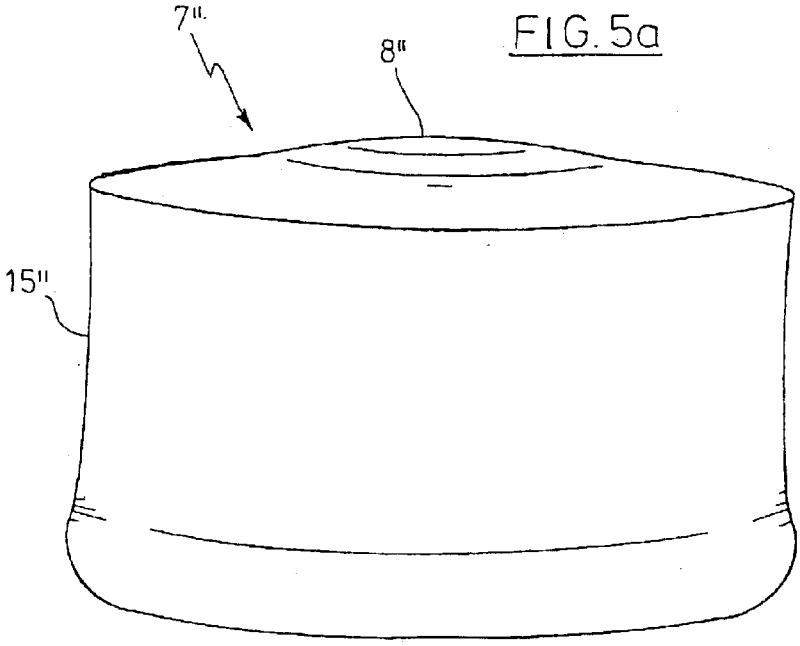
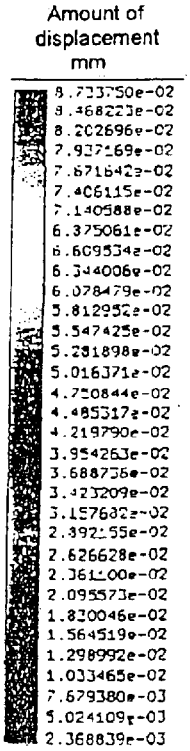
FIG.5b

LID TYPE VESSEL

BACKGROUND OF THE INVENTION

1. Field of the Invention

The invention relates to a lid type vessel of a plastic material for laboratory use, specifically under conditions of an elevated temperature, e.g. in the PCR procedure.

2. Description of the Prior Art

Typically, lid type vessels of the aforementioned type have a filling capacity of a few millilitres or less than one millilitre.

Lid type vessels which are known comprise a vessel and a lid which has a lid bottom and a hollow cylinder on one side of the lid bottom, which either is inserted into a vessel opening like a stopper or is placed onto the vessel end having the vessel opening like a cap to provide sealing on the vessel outer wall. The lid may be formed separately from the vessel and may be joined thereto via a strap hinge.

In the lid type vessels which are known, the lid can become leaky or spring open when the pressure in the vessel rises beyond the ambient pressure. This can occur, for example, when specimens are being tempered in the lid type vessels. In particular, this problem is encountered during the polymerase chain reaction (PCR) during which specimens placed in the lid type vessels undergo treatment by means of so-called thermocyclers at elevated temperatures in order to multiply the DNA. The PCR comprises the three steps of denaturization at 94° C., annealing at 40 to 60° C., and DNA synthesis at 72° C., which are repeated many times (mostly from 25 to 30 times).

If the (varying) pressure load leads to leakiness or causes the lid to spring open contamination might occur in other specimens or the laboratory environment.

Accordingly, it is the object of the invention to provide a lid type vessel which better protects the lid from leakiness and/or prevents it from springing open because of a pressure differential between the interior of the vessel and the environment.

SUMMARY OF THE INVENTION

The object of the invention is achieved by providing a lid type vessel of a plastic material for laboratory use, specifically in the PCR procedure, and including:

- a tubular vessel which has a vessel bottom at one end and a vessel opening at the other end,
- a lid which has a lid bottom and has at least one hollow cylinder on one side of the lid bottom, which is adapted to be inserted into a sealing seat at the vessel inner wall through the vessel opening, and/or which is adapted to be placed onto the end of the vessel having the vessel opening and in a sealing seat on the vessel outer wall, and
- at least one axial portion of the hollow cylinder or vessel in the area of the sealing seat by means of which the hollow cylinder or vessel is alternately subdivided into harder and softer segments in a circumferential direction.

In the inventive lid type vessel, the sealing mates, i.e. the hollow cylinder of the lid and the vessel inner wall or vessel outer wall, bear on each other in the area of the sealing seat at a bias to achieve sealing. The hollow cylinder and the vessel are of a flexural strength which ensures that the lid is closed in a simple and safe manner with the sealing areas not undergoing any deformation preventing lid closure. In conventional lid type vessels, however, the circumferential sealing areas also are very rigid radially so that if there is an elevated pressure in the vessel no or hardly any intensification of the sealing action will be possible by widening the inner sealing mate. In contrast, in the inventive lid type vessels, since there are alternately harder and softer segments in the inner sealing mate, they cause the mate to be widened at least partially at an elevated pressure in the vessel, thus achieving an active intensification of the seal. Moreover, the pressure rising in the vessel increases the retention force acting in the sealing surface that keeps the lid to the lid to the vessel in spite of the intensified force acting on the lid bottom.

Another advantage over vessels having solid stoppers is that the cavity disposed directly below the vessel opening may be utilized as an expansion volume, e.g. when the specimen is being heated or shaken. Moreover, it becomes easier to close the lid as compared to conventional closures because of the softer segments if the allowance is the same between the lid and vessel. Further, working can be done at a smaller allowance if the lid type vessel is designed so as to cause the pressure in the vessel to sufficiently enhance the sealing action and retention force.

The aforementioned benefits also have an effect for a vessel for the cold treatment of specimens if the outer sealing mate is provided with the harder and softer segments because if the ambient pressure exceeds the pressure prevailing in the vessel it will be pressed more intensely against the internally located sealing mate.

According to an aspect, the axial portion of the hollow cylinder extends from the free end of the hollow cylinder or the axial portion of the vessel extends from the end of the vessel having the vessel opening, which helps achieve a particularly large expandability at the free end of the hollow cylinder or at the end of the vessel having the vessel opening, with a concurrent increase in the sealing action and retention force.

According to an aspect, also with a view to increasing the sealing action and retention force, the axial portion of the lid is extended up to the lid bottom or the axial portion of the vessel is extended at least over the whole covering area of the hollow cylinder of the lid placed on top.

According to an aspect, the harder and softer segments have borders which are parallel to the axis or are inclined towards the axis or engage each other. The borders which are parallel to the axis or are inclined towards the axis, in particular, have advantages in injection molding. If there are borders which are inclined towards the axis or engage each other the segments can be caused to get interlocked into each other constructionally, which can be an advantage while they are manufactured from different materials.

According to an aspect, the hollow cylinder or vessel has a soft material layer internally and/or externally, at least in the area of the axial portion.

According to an aspect, the hollow cylinder has a sealing bulge at the free end or the vessel has said bulge at the vessel opening. The bulge is apt to enhance the sealing action, specifically by an increase in surface pressure.

According to an aspect, the sealing bulge is softer than are the harder segments. As a result, the coefficient of friction may be increased specifically between the vessel and lid in order to intensify the retention force.

According to an aspect, the lid or vessel, at the proximal end of the axial portion, has at least one completely or partially circumferential annular portion which is softer than are the harder segments. The at least one annular portion is designed to enhance the radial expandability or compressibility of the axial portion, particularly if it extends along the base of the harder segments.

According to an aspect, the annular portion is arranged at the base of the hollow cylinder in the lid bottom and is softer than is the remaining lid bottom, also with a view to enhancing the radial expandability or compressibility of the axial portion. According to a further aspect, it is for the same reason that the lid bottom has radial portions which radiate outwardly from the annular portion and are also softer than is the remaining lid bottom.

According to an aspect, the softer regions (i.e. the softer segments and/or the sealing bulge and/or the annular portion and/or the radial portions) are comprised of the same material than are the adjacent harder regions (i.e. the harder segments and/or other regions of the lid or vessel) but, in contrast, are of a reduced wall thickness. Softness is increased here by a structural weakening of the materials in the regions concerned.

According to an aspect, the softer regions (i.e. the further segments and/or the sealing bulge and/or the annular portion and/or the radial portions) are comprised of a softer material than are the adjacent harder regions (i.e. the harder segments and/or other regions of the lid or vessel). Softness is increased here by employing softer materials. Softness can also be increased by combining a reduction in wall thickness and material use.

According to an aspect, the lid and/or vessel is/are made of the same soft material at any point within the softer regions and of the same harder material at any point outside said regions. The lid and/or vessel is/are then comprised of only two components.

According to an aspect, the harder material is polypropylene or polyethylene and/or the softer material is silicone or a thermoplastic elastomer or an elastomer or another soft polymeric material. In particular, plastic materials which have particularly good characteristics of adhesion to each other may be employed for the harder material and the softer material.

According to an aspect, the lid type vessel comprises at least two plastic material components of different moduli of elasticity. Preferably, the softer segments are made of a material the modulus of elasticity of which is lower by one or more powers of ten than is the modulus of elasticity of the material of which the harder segments are made.

The invention comprises forming the vessel and lid each from a separate component. The invention further comprises vessels and lids which are separate components adapted to be joined to each other, e.g. by means of a web which is integrally joined to one of the components and has a ring for being joined to the outer circumference of the other component. If formed separately, both the lid and vessel may be made completely or partially of the same plastic material or materials. However, they may also be comprised of different plastic materials or may be completely made of different plastic materials. The manufacturing techniques for the lid and vessel specifically include single-component and/or multi-component injection molding processes.

According to an aspect, both the lid and vessel are integrally manufactured in a single-component or multi-component injection molding process. Then, they may specifically comprise a film type hinge which joins the lid and vessel to each other. Likewise, however, this includes a possibility of releasably interconnecting the lid and vessel via a point of separation with the point of separation requiring to be undone to close the vessel.

According to an aspect, the lid is made of an elastic plastic material in its radius central area to provide self-acting sealing properties following a perforation, e.g. by means of a cannula for sampling purposes.

BRIEF DESCRIPTION OF THE DRAWINGS

Embodiments of the invention are illustrated in the drawings and will be described in more detail below. In the drawings:

FIGS. 4*a* and 4*b* show another lid in a non-loaded condition (marked by continuous lines) and loaded by an internal pressure (in different dark shades according to deformation) in a perspective sectional view (FIG. 4*a*) and a legend with the dark shades associated with the extent of deformation, in millimetres (FIG. 4*b*);

FIGS. 5*a* and 5*b* show a lid of a conventional lid type vessel in a condition loaded by an internal pressure (in different dark shades according to deformation) in a perspective side view (FIG. 5*a*) and a legend with the dark shades associated with the extent of deformation, in millimetres (FIG. 5*b*);

DETAILED DESCRIPTION OF THE PREFERRED EMBODIMENT

In the following explanation of various embodiments, equally designated elements are given equal reference numbers. If these elements exhibit structural differences those are marked by (an) upper inverted comma(s) to the reference numbers.

Figure 1:
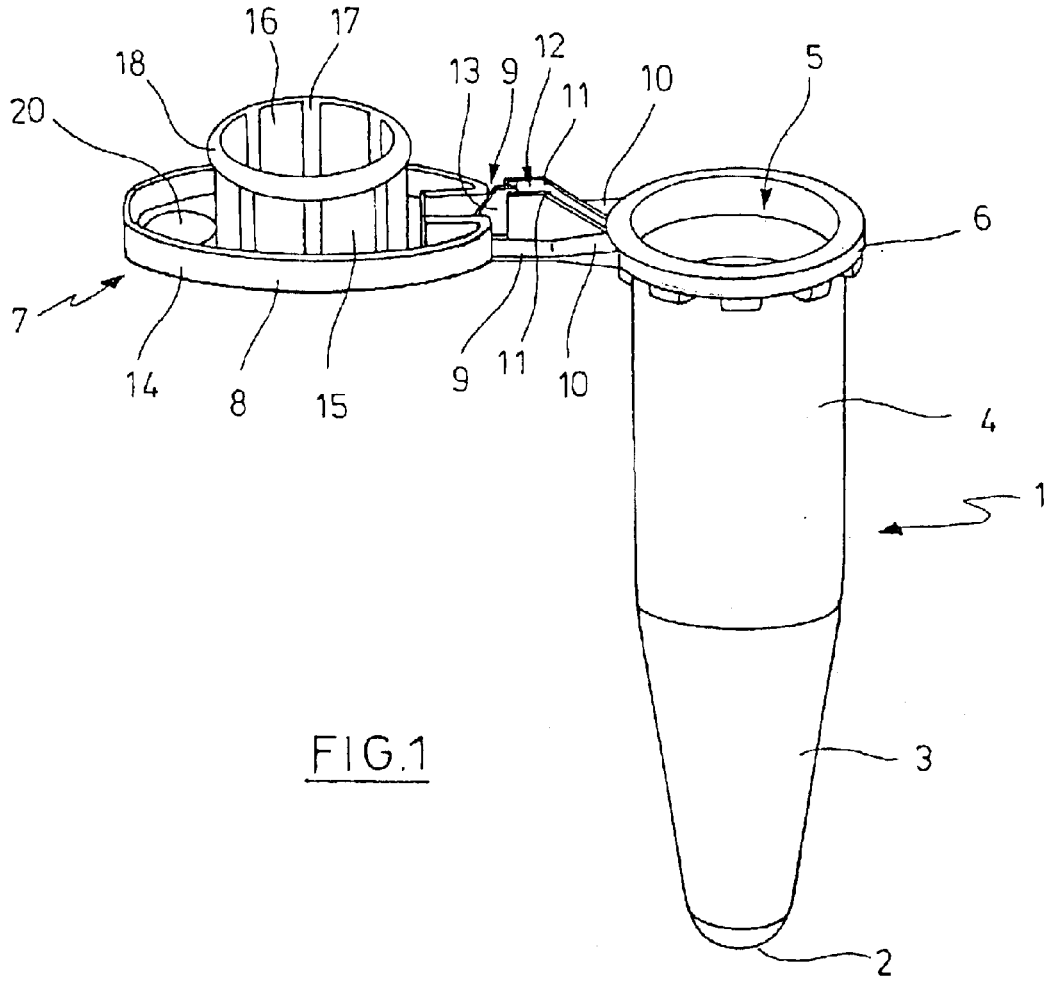
FIG. 1 shows a lid type vessel having harder and softer segments with borders parallel to the axis in the lid with the lid opened, in a perspective side view.
Figure 2:
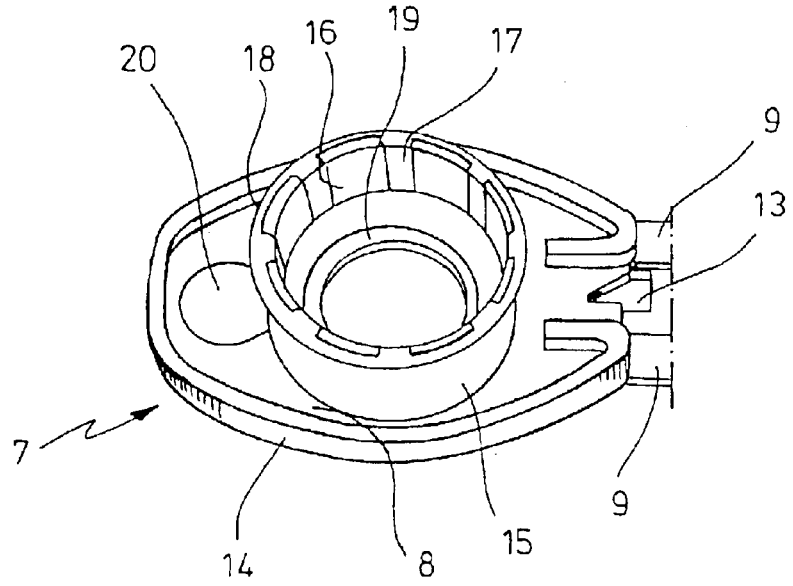
FIG. 2 shows the lid of the same lid type vessel in a perspective view as seen obliquely from top.
Figure 3:
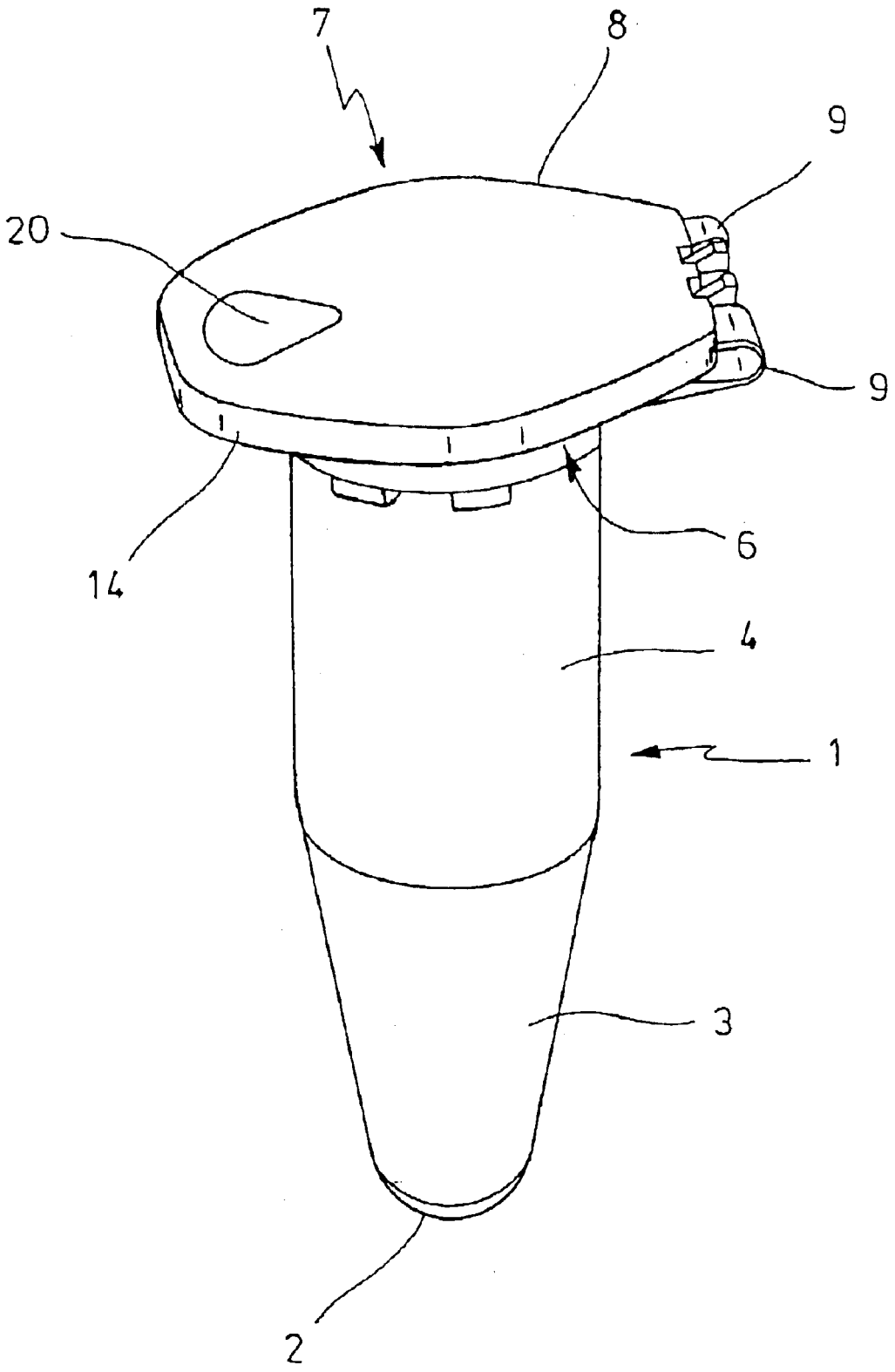
FIG. 3 shows the same lid type vessel closed in a perspective side view.

The lid type vessel of FIGS. 1 to 3 comprises a vessel 1 including a cup-shaped bottom 2, an adjacent conical portion 3, and a cylindrical portion 4 adjoining thereto which has a vessel opening 5 and a vessel flange 6 surrounding it.

The lid type vessel further has a lid 7 including a lid bottom 8 which, in the example, approximately has the shape of two identical isoceles trapezoids which are closely placed side by side on the large base line.

The vessel flange 6 is joined to the lid bottom 8 via two parallel strap hinges 9 which exhibit lateral portions 10 in which they virtually are inflexible, adjacent to the vessel flange 6.

Between the strap hinges 9, two parallel fork prongs 11 forming a gap 12 therebetween extend from the vessel flange 6. The gap 12 has directed thereto a catch nose 13 which has its tip joined to the lid bottom 8.

Details of these catch elements and their functions are described in U.S. Pat. No. 5,863,791 with particular reference to FIGS. 1 to 4 the content of which is incorporated herein by reference thereto.

At its border, the lid bottom 8 has an edging 14 which extends from the inside thereof. The edging 14 is interrupted in the area of the catch nose 13.

The lid bottom 8 internally carries a hollow cylinder 15 which is at a spacing from the edging 14 along the entire circumference and protrudes from the edging.

In a circumferential direction, the hollow cylinder 15 is subdivided into harder segments 16 and softer segments 17 which extend over the entire hollow cylinder 15 in an axial direction. The harder segments 16 may be variably configured in their relationship with the softer segments 17 in large areas and have an optimum ratio of 1:1 regarding their extension in a circumferential direction.

At the free end, the hollow cylinder 15 externally has a circumferential sealing bulge 18 which is also softer than the harder elements 16.

At the base of the hollow cylinder, the lid bottom 8 internally has an annular portion 19 which runs circumferentially at the inner circumference of the hollow cylinder and is also made of a softer material than are the harder elements 16.

Moreover, the lid bottom 8 has a drop-shaped softer area 20, which passes through the lid bottom 8, on the side opposite the film hinges 9 in the spacing area of the edging 14 and the hollow cylinder 15.

The softer segments 17, the sealing bulge 18, the annular portion 19, and the drop-shaped area 20 are manufactured from the same softer material.

The remaining areas of the lid bottom 8 are made of the same harder material as are the harder segments 16. The hinges 9, catch elements 12, 13, and vessel 1 are also made of this material.

The whole lid type vessel is manufactured from the two materials by a two-component injection molding process. After the harder material is injection molded the softer segments 17 in the gaps between the segments 16, the sealing gap 18 and the drop-shaped area 20 are made by filling in the softer material, via the annular portion 19.

The lid 7 is closed by forcing the hollow cylinder 15 into the vessel opening 5. As a result, the sealing bulge 18 comes to bear on the vessel inner wall while being biased, i.e. it forms a sealing seat with the wall. In this sealing position, the bottom 8 laterally projecting over the hollow cylinder 15 is supported at top on the vessel flange 6.

When pressure increases in the vessel 1 the hollow cylinder 15 widens because of the soft, expandable segments 17. This intensifies the sealing action between the sealing bulge 18 and the vessel inner wall and, moreover, enhances the frictional force applied by the vessel inner wall to the sealing bulge 18. The result is that the lid 7 is secured from being pressed on by the force acting on the lid bottom 8.

FIGS. 4 and 5, which show the results of FEM (Finite Elements Method) calculations explicate the differing deformation behaviour of an inventive lid and a conventional lid at a pressure of 4 bar in the vessel.

The calculations were made assuming that the harder material of the inventive lid 7' is a polypropylene having a modulus of elasticity of 1,400 Newton/mm2 and the conventional lid 7' is completely made of this material. A thermoplastic elastomer having a modulus of 6.1 Newton/mm2 was assumed to be a basis for the softer material of the inventive lid.

For simplification, the calculations were made for lids 7', 7" where the lid bottom 8', 8" does not exhibit a lateral projection over the hollow cylinder 15', 15". In the inventive lid 7' where the hollow cylinder 15' is alternately provided with harder segments 16' and softer segments 17' along the entire axial length in a circumferential direction the heaviest deformation results at the free end where sealing is done with respect to the vessel inside. The lid bottom 8' virtually is not deformed. For the conventional lid 7", virtually no deformations result at the free end, but the heaviest deformations are encountered at the centre of the lid bottom 8" instead.

Figure 6:
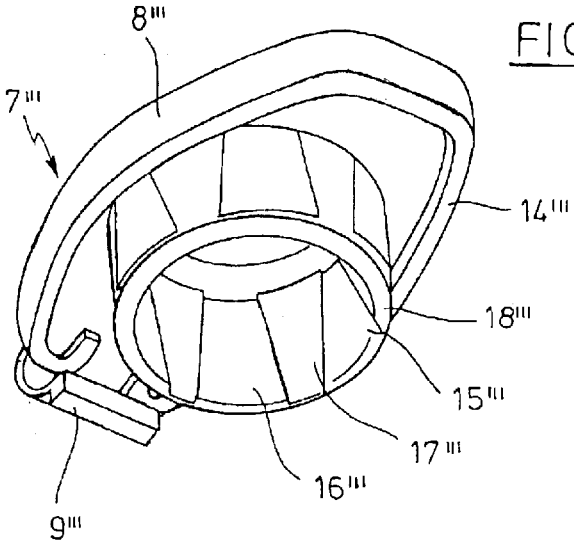
FIG. 6 shows another lid having harder and softer segments with borders inclined towards the axis in a perspective bottom view.
Figure 7:
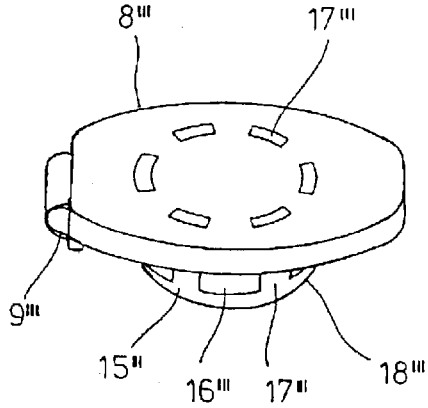
FIG. 7 shows the same lid in a perspective view as seen obliquely from top.

According to FIGS. 6 and 7, a further lid 7''' has harder segments 16''' and softer segments 17''' where sides are inclined obliquely towards the axis with the harder segments 16''' tapering towards the lid bottom 8''' and the softer segments 17''' tapering towards the free end of the hollow cylinder 15'''. The material of the harder segments 17''' extends up to the upper side of the lid bottom 8'''. This is a way to cause the soft component to get constructionally interlocked with the hard component.

Figure 9:
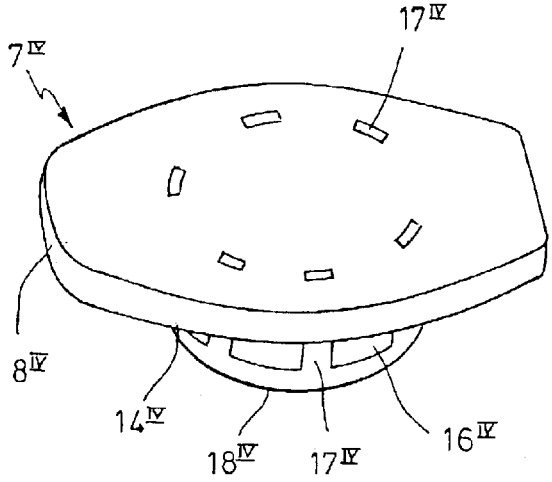
FIG. 9 shows the same lid in a perspective view as seen obliquely from top.
Figure 8:
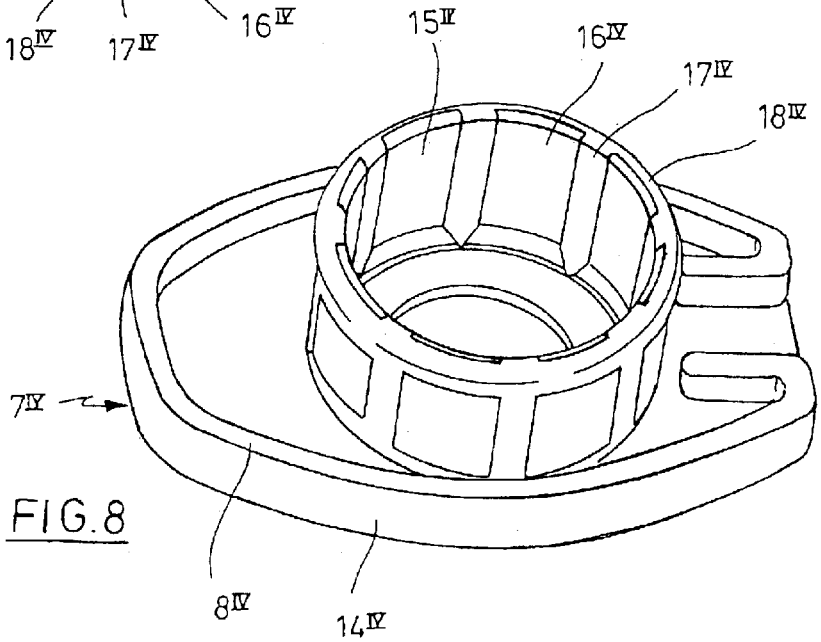
FIG. 8 shows another lid having segments parallel to the axis and softer annular portions in the lid bottom in a perspective view as seen obliquely from bottom.

The lid $7^{IV}$ of FIGS. 8 and 9 differs from the lid 7 of FIGS. 1 to 3 in that an annular portion $19^{IV}$ runs fully circumferentially on the shell of the hollow cylinder $15^{IV}$ at the base of the hollow cylinder $15^{IV}$ and extends up to the upper side of the lid bottom $8^{IV}$ above the harder segments $16^{IV}$. Since wall thicknesses are reduced in the material of the harder segments $16^{IV}$ at the bottom of the hollow cylinder $5^{IV}$ the radial rigidity of the hollow cylinder $15^{IV}$ undergoes further reduction and its outward flexibility is increased.

The back-off clearance cut to manufacture the annular portion $19^{IV}$ may be realized by means of a slotted, annular tool core which plunges through the lid $7^{IV}$.

Figure 10:
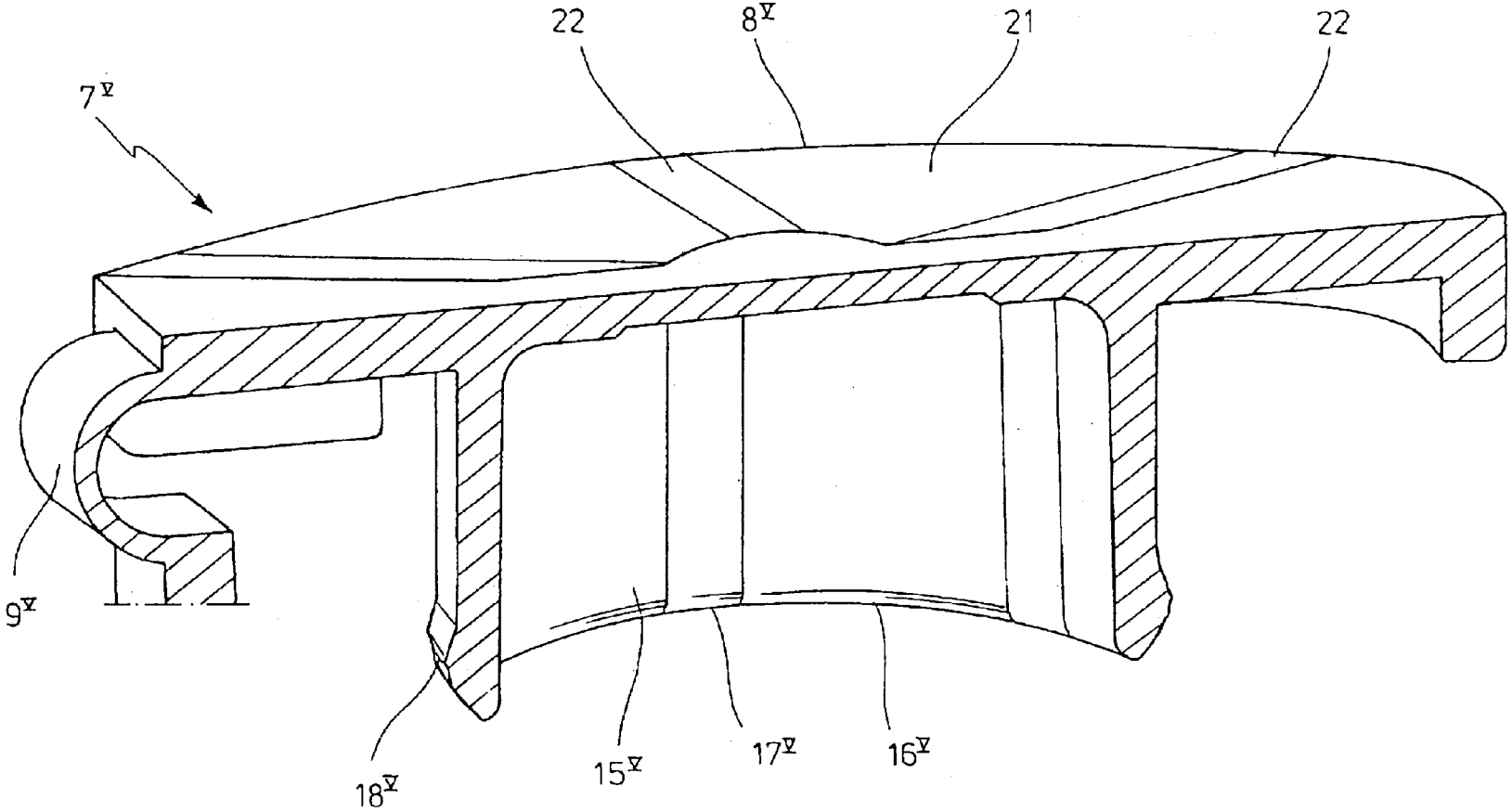
FIG. 10 shows another lid of a further lid type vessel with segments parallel to the axis and softer annular portions and radial portions in the lid bottom in a perspective sectional view as seen obliquely from top.

According to FIG. 10, the rigidity of the lid bottom $8^{V}$ of the lid $7^{V}$ is reduced by annular portions 21 in the lid bottom $8^{V}$ and radial portions 22 which extend therefrom and are of a softer component. This results in a reduction in rigidity of the hollow cylinder $15^{IV}$ and, hence, an improvement to its expandability.

What is claimed is:

1. A lid type vessel of an elastic material for laboratory use, comprising:

a tubular vessel having a bottom at one end thereof, an opening at another, opposite end thereof, and inner and outer walls; and a lid having a bottom and at least one hollow cylinder provided on one side of the lid bottom and including means for sealingly engaging one of the inner wall of the tubular vessel and the outer wall of the tubular vessel upon one of, respectively, being inserted through the vessel opening and being placed onto the another end of the tubular vessel, wherein one of the hollow cylinder and the vessel has at least one axial portion provided in area of a sealing engagement of the hollow cylinder with the one of the inner wall of the tubular vessel and the outer wall of the tubular vessel and formed of alternating, in a circumferential direction, harder segments and softer segments.

2. The lid type vessel as claimed in claim 1, wherein the one of the hollow cylinder and the vessel is the hollow cylinder, and the axial portion extends from a free end of the hollow cylinder.

3. The lid type vessel as claimed in claim 1, wherein the one of the hollow cylinder and the vessel is the vessel, and the axial portion extends from an end of the another end of the tubular vessel.

4. The lid type as claimed in claim 2, wherein the axial portion extends up to the lid bottom.

5. The lid type vessel as claimed in claim 3, wherein the axial portion extends at least over an entire contact area of the vessel with the hollow cylinder.

6. The lid type vessel according to claim 1, wherein the harder and softer segments have borders which are one of parallel to an axis of the one of the vessel and the hollow cylinder, inclined toward the axis, and engage each other.

7. The lid type vessel as claimed in claim 1, wherein the hollow cylinder is inserted through the vessel opening and has a sealing bulge at a free end thereof forming the sealingly engaging means.

8. The lid type vessel as claimed in claim 1, wherein the hollow cylinder is placed onto the another end of the tubular vessel, and the vessel has a sealing bulge provided at an edge of the opening.

9. The lid type vessel as claimed in claim 7, wherein the sealing bulge is softer than the harder segments.

10. The lid type vessel as claimed in claim 8, wherein the sealing bulge is softer than the harder segments.

11. The lid type vessel as claimed in claim 1, wherein at least one partially circumferential annular portion, which is softer than the harder segments, is provided at a proximal end of the at least one axial portion.

12. The lid type vessel as claimed in claim 2, wherein at least partially circumferential annular portion is provided at a base of the hollow cylinder in the lid bottom and is softer than a remaining portion of the lid bottom.

13. The lid type vessel as claimed in claim 12, wherein the lid bottom has radial portions extending radially outwardly from the annular portion and are softer than the remaining portion of the lid bottom.

14. The lid type vessel as claimed in claim 12, wherein the softer segments, the annular portion, and the radial portions are formed of a same material as the harder segments and the remaining portion of the lid bottom but have a reduced wall thickness.

15. The lid type vessel as claimed in claim 12, wherein the softer segments, the annular portion, and the radial portions are formed of a first, softer material, and the harder segments and the remaining portion of the lid bottom are formed of a second, harder material.

16. The lid type vessel as claimed in claim 15, wherein the second harder material is selected from the group consisting of polypropylene and polyethylene, and the first, softer material is selected from the group consisting of silicone, thermoplastic elastomer, elastomer.

* * * * *